US005558982A

United States Patent [19]

Maskasky

[11] Patent Number: 5,558,982

[45] **Date of Patent: *Sep. 24, 1996**

[54] HIGH CHLORIDE (100) TABULAR GRAIN EMULSIONS WITH MODIFIED EDGE STRUCTURES

[75] Inventor: Joe E. Maskasky, Rochester, N.Y.

[73] Assignee: Eastman Kodak Company, Rochester, N.Y.

[ * ] Notice: The term of this patent shall not extend beyond the expiration date of Pat. No. 5,399,477.

[21] Appl. No.: 530,544

[22] Filed: Sep. 19, 1995

Related U.S. Application Data

[63] Continuation of Ser. No. 360,489, Dec. 21, 1994, abandoned.

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,386,156 | 5/1983 | Mignot | 430/567 |
| 4,439,520 | 3/1984 | Kofron et al. | 430/434 |
| 5,061,617 | 10/1991 | Maskasky | 430/569 |
| 5,275,930 | 1/1994 | Maskasky | 430/567 |
| 5,292,632 | 3/1994 | Maskasky | 430/567 |
| 5,310,635 | 5/1994 | Szajewski | 430/496 |
| 5,314,798 | 5/1994 | Brust et al. | 430/567 |
| 5,320,938 | 6/1994 | House et al. | 430/567 |
| 5,356,764 | 10/1994 | Szajewski et al. | 430/505 |
| 5,399,477 | 3/1995 | Maskasky | 430/567 |
| 5,399,478 | 3/1995 | Maskasky | 430/569 |

FOREIGN PATENT DOCUMENTS

0569971A2 11/1993 European Pat. Off. ..... G03C 1/005

OTHER PUBLICATIONS

K. Endo & M. Okaji, "An Empirical Rule to Modify the Crystal Habit of Silver Chloride to Form Tabular Grains in an Emulsion", *J. Photographic Science,* 1988, vol. 36 (1988), pp. 182–189.

*Primary Examiner*—Janet C. Baxter
*Attorney, Agent, or Firm*—Carl O. Thomas

[57] ABSTRACT

Photographic emulsions are disclosed in which at least 50 percent of total grain projected area is accounted for by high (>90%) chloride thin (<0.2 μm) high average aspect ratio (>8) tabular grains having {100} major faces each having at least one edge face oriented in an atomic plane differing from that of major faces to improve photographic performance.

6 Claims, 2 Drawing Sheets

HIGH CHLORIDE (100) TABULAR GRAIN EMULSIONS WITH MODIFIED EDGE STRUCTURES

This is a continuation of U.S. Ser. No. 360,489, filed Dec. 21, 1994, now abandoned.

FIELD OF THE INVENTION

The invention relates to radiation sensitive photographic emulsions.

BACKGROUND

During the 1980's a marked advance took place in silver halide photography based on the discovery that a wide range of photographic advantages, such as improved speed-granularity relationships, increased covering power (both on an absolute basis and as a function of binder hardening), more rapid developability, increased thermal stability, increased separation of native and spectral sensitization imparted imaging speeds, and improved image sharpness in both mono- and multi-emulsion layer formats, can be achieved by employing thin, high aspect ratio tabular grain emulsions. These advantages are demonstrated in Kofron et al U.S. Pat. No. 4,439,520.

An emulsion is generally understood to be a "thin, high aspect ratio tabular grain emulsion" when tabular grains having a thickness (t) of less than 0.2 μm account for at least 50 percent of total grain projected area and the tabular grains have a mean aspect of greater than 8. A grain is easily visually recognized to be a tabular grain when it contains two parallel major faces that are substantially larger than any remaining faces. Quantitatively, a grain with parallel major faces is generally considered to be a tabular grain when its aspect ratio, the ratio of its equivalent circular diameter (ECD) to its thickness (t), is at least 2.

Initially practical interest in tabular grain emulsions centered on applications in camera speed taking films and in indirect radiography (radiographic imaging in which the tabular grain emulsions are image-wise exposed by light emitted from intensifying screens when the screens are exposed to X-radiation). For camera speed films silver iodobromide emulsions have been traditionally preferred and for radiographic films silver bromide emulsions (optionally containing up to about 3 mole percent iodide) have been preferred. The thin, high aspect ratio tabular grain emulsions that have served these applications have contained tabular grains having opposed {111} major faces. The {111} major faces of the tabular grains exhibit a three-fold symmetry, appearing hexagonal or triangular.

Relatively recently interest has increased in the photographic art in combining the known advantages of thin, high aspect ratio tabular grain emulsions with the advantages of high chloride grain structures. The term "high chloride" as applied to grain structures and emulsions is herein employed to indicate at least 90 mole percent chloride, based on silver. The advantages that high chloride emulsions offer over those of other halide compositions include lower native blue sensitivity (thereby contributing to the lower color contamination when used as green or red recording emulsion layers), more rapid development rates, and rapid fixing with ecologically preferred sulfite ion fixers.

It was recognized from the outset that quite different emulsion preparation strategies must be practiced to obtain tabular grain emulsions of differing halide content. Although Kofron et al disclosed high chloride tabular grain emulsions, a difficulty that was encountered is that silver chloride exhibits a strong preference for forming grain structures with {100} crystal faces. The high chloride tabular grain emulsions disclosed by Kofron et al exhibit {111} major faces. The use of high chloride {111} tabular grain emulsions has been hampered by the requirement to employ a morphological stabilizer to prevent high chloride {111} tabular grains from reverting to nontabular forms.

Mignot U.S. Pat. No. 4,386,156 (summarized in column 17 of Kofron et al) discloses the preparation of silver bromide tabular grains with {100} major faces. Saito EPO 0 569 971 discloses modified forms of {100} tabular grains containing at least 25 mole percent bromide.

Relatively recently thin, high aspect ratio, high chloride tabular grain emulsions have been discovered that exhibit {100} crystal faces. By preparing high chloride tabular grains for the first time in an inherently stable crystal form, the complications of morphological stabilizers have been eliminated and remarkable levels of photographic performance have been observed. The sensitivities of these emulsions have approached the sensitivity levels of the more efficient silver iodobromide emulsions. These thin, high aspect ratio, high chloride {100} tabular grain emulsions are illustrated by Maskasky U.S. Pat. Nos. 5,275,930 and 5,292,632; House et al U.S. Pat. No. 5,320,938; Szajewski et al U.S. Pat. Nos. 5,310,635 and 5,356,764; and Brust et al U.S. Pat. No. 5,314,798.

K. Endo and M. Okaji, "An Empirical Rule to Modify the Crystal Habit of Silver Chloride to Form Tabular Grains in an Emulsion", *J. Photographic Science,* 1988, Vol. 36, (1988), pp. 182–189, set out to produce an empirical rule for selecting materials for use as grain growth modifiers in preparing silver chloride tabular grain emulsions by double-jet precipitation. The rule was tested by adding various ligands, $CN^-$, $SCN^-$, $I^-$, $(S_2O_3)^{-2}$, $(SO_3)^{-3}$ and thiourea (including derivatives) to 3M sodium chloride solutions at concentrations of 0.001, 0.005, 0.01 and 0.1M. The 3M sodium chloride solution was then used with 2M silver nitrate in double-jet precipitations. Tabular grains having {100} and {111} faces were produced. Based on these investigations Endo et al concluded that to be useful as a grain growth modifier in forming tabular grain high chloride emulsions the first formation constant of the ligand, $\beta_1(L)$, must be more than $\beta_2(Cl^-)$—i.e., $\beta_2(Cl^-)/\beta_1(L)$ must be less than unity (one). In Table 2 Endo et al reported $\beta_2(Cl^-)/\beta_1(L)$ for $SCN^-$ to be 6.3, thereby indicating $SCN^-$ not to be suitable for use as a grain growth modifier. In FIG. 7 Endo et al shows a relatively thick silver chloride grain population produced using 0.10M KSCN.

Maskasky U.S. Pat. No. 5,061,617 discloses employing thiocyanate as a grain growth modifier for the formation of high chloride tabular grains having {111} major faces.

Maskasky U.S. Pat. No. 5,399,477 is directed to a photographic element containing an emulsion with silver halide grains having two parallel {100} major faces and {111} or {110} corner faces or {110} side faces that are formed by non-epitaxial deposits that protrude from the {100} major faces.

SUMMARY OF THE INVENTION

A radiation sensitive emulsion containing a silver halide grain population comprised of at least 90 mole percent chloride, based on silver, wherein at least 50 percent of the total grain population projected area is accounted for by tabular grains (1) bounded by {100} major faces having adjacent edge ratios of less than 10, (2) having a thickness of less than 0.2 μm, and (3) having an average aspect ratio of greater than 8; wherein each of the tabular grains accounting for at least 50 percent of the total grain projected area (4) contains at least one crystal face that lies in an atomic plane differing from that of the major faces and (5) exhibits a lower grain volume than a tabular grain of the same length, width and thickness bounded entirely by crystal faces lying in {100} atomic planes.

By providing the tabular grains with at least one edge that lies in an atomic plane different from that of the {100} major faces, a different surface pattern of $Ag^+$ and $Cl^-$ ions are provided as compared to the major faces of the grains, and the photographic utility of the grains is enhanced. Whereas the major faces of the tabular grains lie in {100} atomic planes, from one to twelve edge surfaces of the grains lie in one or more other atomic planes—that is, non-{100} crystal planes. This allows different grain performance enhancing compounds (e.g., spectral sensitizing dyes, chemical sensitizers, antifoggants and stabilizers) to be used in combination selected on the basis of different preferred crystal face affinities. This reduces competition between these compounds for surface sites. For example, by reducing competition between chemical sensitizers and spectral sensitizing dyes, reduced dye desensitization can be achieved. As another example of photographic benefits, dye displacement by antifoggants and stabilizers can be minimized.

Grain thicknesses have been relatively increased in FIGS. 2A, 2B, 3A, 3B and 4 to facilitate visualization of features.

DESCRIPTION OF PREFERRED EMBODIMENTS

Figure 4:
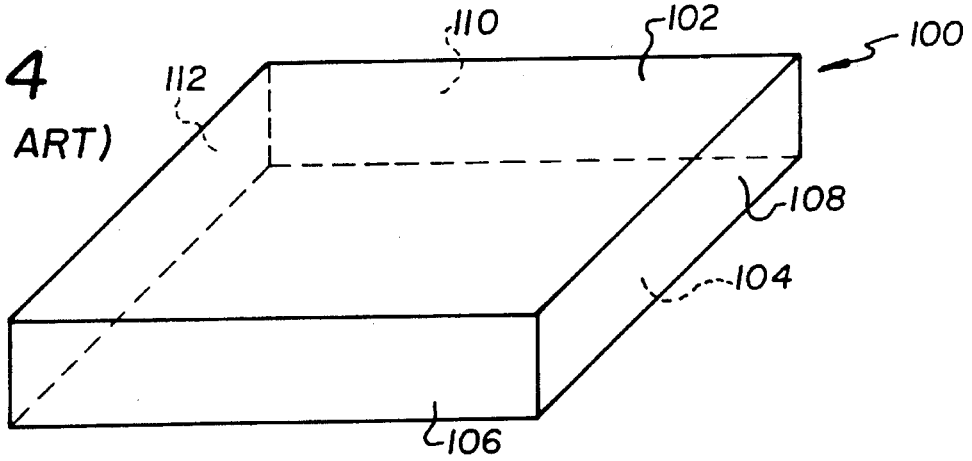
FIG. 4 (PRIOR ART)
FIG. 4 is an isometric view of a conventional {100} tabular grain.

In FIG. 4 a conventional {100} tabular grain 100 is illustrated. The tabular grain has an upper major face 102 and a parallel lower major face 104. In addition the grain has four edge faces 106, 108, 110 and 112 that are oriented perpendicular to the major faces. Each of the edge faces are oriented either parallel to or perpendicular to another edge face. Each of the six faces 102, 104, 106, 108, 110 and 112 lie in a {100} atomic plane.

Figure 1A:
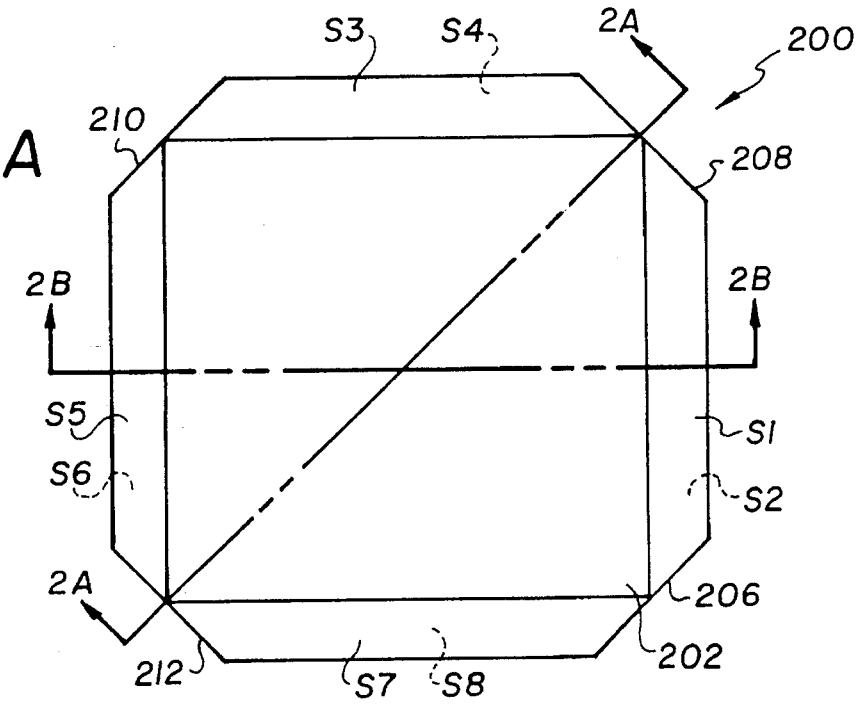
FIG. 1A is a view normal to a {100} major face of an ideal thin, high aspect ratio tabular grain satisfying the requirements of the invention having edge crystal faces lying in {110} atomic planes.
Figure 1B:
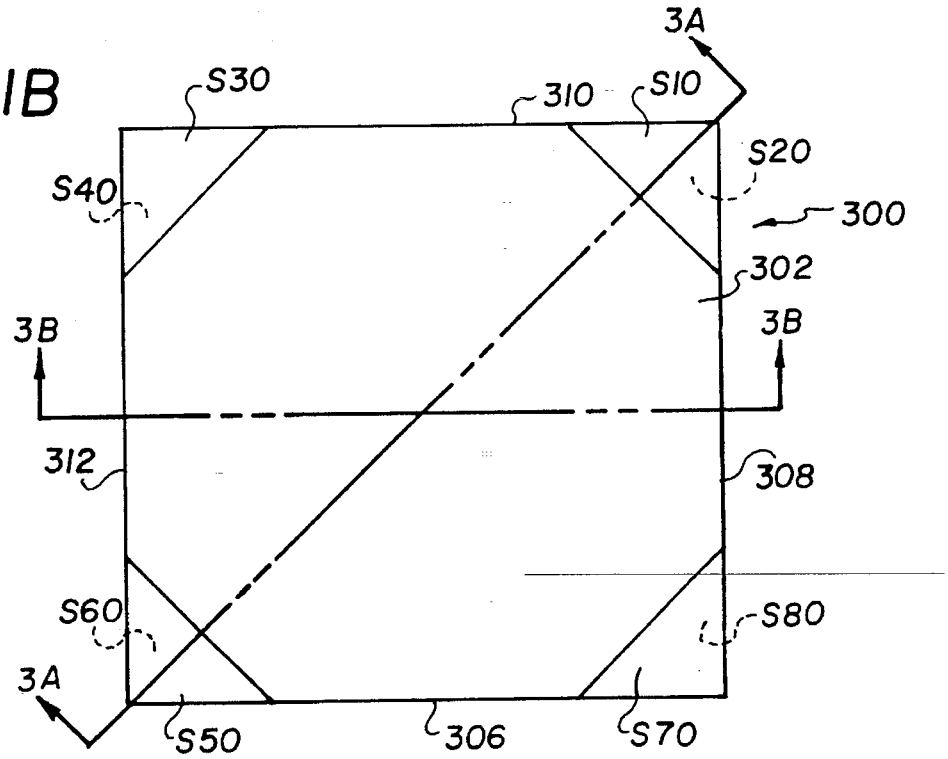
FIG. 1B is a view normal to a {100} major face of an ideal thin, high aspect ratio tabular grain of an alternate form satisfying the requirements of the invention having edge crystal faces lying in {111} atomic planes.
Figure 2A:
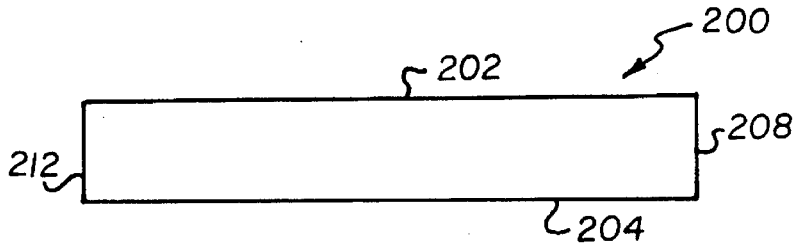
FIGS. 2A and 2B are sectional views taken along section lines 2A—2A and 2B—2B, respectively, in FIG. 1A.
Figure 2B:
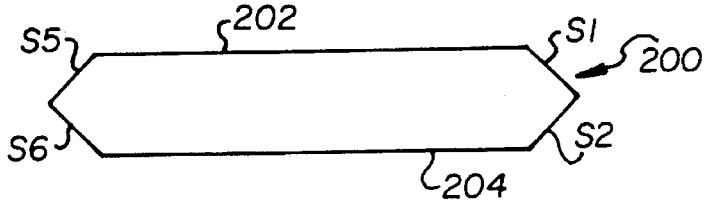

In FIGS. 1A, 2A and 2B a tabular grain 200 is shown which represents one ideal form that the tabular grains in the emulsions of the invention can take. The tabular grain is in part bounded by parallel {100} atomic planes forming major faces 202 and 204. In addition the tabular grain has eight sloping edge faces, with sloping faces S1, S3, S5 and S7 intersecting the upper {100} major face 202 and sloping faces S2, S4, S6 and S8 intersecting the lower {100} major face 204. From FIGS. 1A and 2B it is apparent that the sloping edge faces each extend from an edge of a major face to a peripheral grain edge that is laterally displaced from the major faces. Four additional edge faces 206, 208, 210 and 212 are oriented perpendicular to the {100} major faces. By comparing the orientations of the edge faces of grain 200 with the orientations of the edge faces of grain 100, it is apparent that none of the edge faces of the grain 200 lie in a {100} atomic plane. In grain 200 each of the edge faces lie in {110} atomic planes. From FIGS. 1B and 3A it is apparent that the sloping edge faces each extend from a major face to a peripheral grain corner that is laterally displaced from the major face.

Figure 3A:
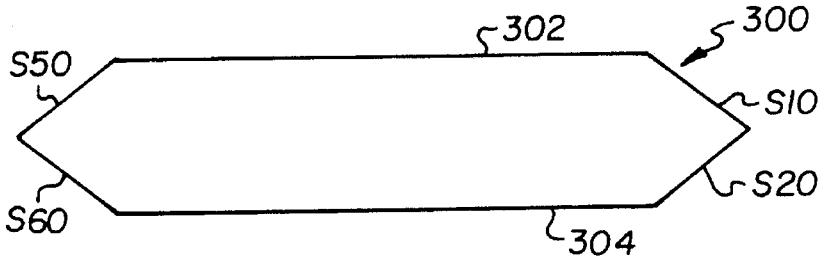
FIGS. 3A and 3B are sectional views taken along section lines 3A—3A and 3B—3B, respectively, in FIG. 1B.
Figure 3B:
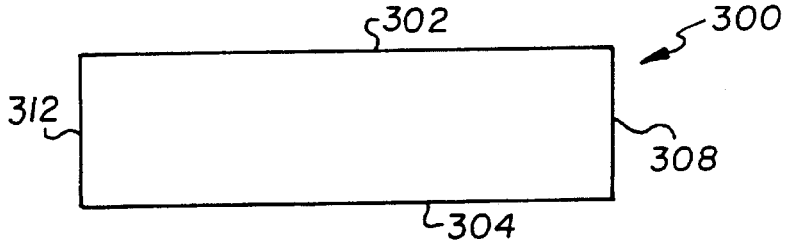

An alternate ideal form of a tabular grain satisfying the requirements of the emulsions of the invention is shown FIG. 1B, 3A and 3B. The tabular grain 300 is in part bounded by parallel {100} major faces 302 and 304. In addition the tabular grain has four edge faces 306, 308, 310 and 312 that are oriented with respect to the major faces similarly as the edge faces in tabular grain 100. That is, these four edge faces are {100} crystal faces. In addition the tabular grain 300 has eight identical sloping edge faces, with sloping edge faces S10, S30, S50 and S70 intersecting the upper major face 302 of the grain and sloping edge faces S20, S40, S60 and S80 intersecting the lower major face of the grain. The sloping edge faces lie in {111} atomic planes.

A difference between {100} tabular grain 100 and the ideal tabular grains 200 and 300 satisfying the requirements of the invention is that the latter exhibit a lower grain volume than tabular grains bounded entirely by {100} crystal faces of the same length, width and thickness. The non-{100} edges of the grains 200 and 300 give the appearance of {100} tabular grains with one or more corners removed. Hence, a name that has been applied to these grains is "cut corner" grains (although, in reality, the corners are not cut away, but simply never formed). An advantage of this is that the tabular grains 200 and 300 require less silver to provide the same projected area for light capture than the tabular grains 100. Another distinguishing feature of the tabular grains 200 and 300 is common to all tabular grains satisfying the requirements of the invention is that the non-{100} crystal faces do not protrude above the plane of the nearest {100} major face, again contributing to reduced grain volume, based on displacement dimensions.

The emulsions of the invention are similar to conventional thin, high aspect ratio, high chloride tabular grain emulsions in that at least 50 percent, preferably at least 70 percent and optimally at least 90 percent of total grain projected area is accounted for by tabular grains having {100} major faces. Whereas the tabular grains 100, 200 and 300 are shown to have major faces of approximately equal length and width, rectangular major faces (with clearly unequal lengths and widths) are common. Therefore, to distinguish the tabular grains from more rod-like grains, the length to width ratio of the grains must be less than 10 and is preferably less than 5 and optimally less than 2.

The tabular grains accounting for at least 50 percent of total grain projected area have a thickness of less than 0.2 μm. In fact, the tabular grains can have any conventional lower thickness desired. For example, as demonstrated in the Examples below, the tabular grains can be ultrathin—that is, exhibit a mean thickness of less than 0.07 μm.

The tabular grains accounting for at least 50 percent of total grain projected area have a mean aspect ratio of greater than 8 and preferably at least 12. Since the tabular grain structures satisfying the edge requirements of the invention can be grown in the same thickness and ECD ranges as conventional thin, high aspect ratio {100} tabular grain emulsions, it is apparent that similar mean aspect ratios can be realized.

The tabular grains contain at least 90 mole percent chloride, based on total silver. The remaining halide, if any, can be any convenient combination of bromide and/or iodide. Silver chloride emulsions, those lacking any intentional inclusion of bromide and/or iodide, are specifically contemplated. As demonstrated in the Examples below certain techniques for forming the tabular grain structures of the invention rely upon the inclusion of iodide in the grains. Thus, in one specific, preferred form the tabular grains can consist essentially of silver iodochloride. Optimum iodide concentrations vary, depending upon the photographic application. For example, camera speed films can accommodate iodide concentrations of up to 10 mole percent. For rapid access processing in radiography iodide levels are typically chosen to be less than 3 mole percent, based on silver. In color print emulsions iodide levels are typically maintained at less than 1 mole percent, based on silver. All of these identified photographic applications can accept emulsions containing up to 10 mole percent bromide.

A common distinction between each of the emulsions of the invention and otherwise similar conventional emulsions is that the {100} tabular grains accounting for at least 50 (preferably at least 70 and optimally at least 90) percent of total grain projected area contain non-{100} edge structures.

The ideal tabular grain structure 200 is shown with twelve equal {110} edge faces while the ideal grain structure 300 is shown with eight identical {111} edge faces. These grains are stated to be ideal, since achieving emulsion precipitations with minimal random grain variance affords maximum control over photographic performance. In ideal emulsions the edges of the tabular grains accounting for at least 50 percent of total grain projected area are similarly (equivalently) modified to a non-{100} form.

Some preparation techniques lend themselves to forming ideal grain structures with little grain to grain variance (i.e., monodispersity) within a wider range of conditions than others. Grain variances can be reduced by assuring the uniform availability of reactants. This is more easily accomplished in smaller scale precipitations. In some precipitations in which ideal levels of reactant uniformity are not conveniently realized (e.g., larger scale precipitations), the corners of the tabular grains are non-equivalently modified. That is, the non-{100} crystal face or faces adjacent one corner may be larger than another. Further, one or more corners may be so minimally modified that it is difficult to ascertain whether the grain corner has a non-{100} crystal face or merely rounded by ripening.

Significant photographic advantages can be realized when the tabular grains with {100} major faces accounting for at least 50 percent of total grain projected area contain at least one crystal face lying in a different atomic plane than the {100} major faces. All of the grains produced in precipitation of a high chloride emulsion exhibit a face centered cubic crystal lattice structure, regardless of whether the grains are tabular or nontabular. Further, this is independent of the atomic planes in which the grain surfaces lie. However, it is important to note that the spatial pattern of $Ag^+$ and $Cl^-$ at the grain surface differs markedly, depending upon the atomic plane in which the grain surface lies. Maskasky U.S. Pat. No. 4,643,966 pictorially illustrates $Ag^+$ and $Br^-$ patterns in {100}, {110}, {111} and four higher index, less common crystal planes. The patterns shown by Maskasky are also formed by AgCl, except that the $Cl^-$ is smaller than the $Br^-$.

The $Ag^+$ and $Cl^-$ pattern in a {100} atomic plane is schematically shown below:

```
Ag Cl Ag Cl Ag Cl Ag Cl Ag Cl
Cl Ag Cl Ag Cl Ag Cl Ag Cl Ag
Ag Cl Ag Cl Ag Cl Ag Cl Ag Cl
Cl Ag Cl Ag Cl Ag Cl Ag Cl Ag
Ag Cl Ag Cl Ag Cl Ag Cl Ag Cl
Cl Ag Cl Ag Cl Ag Cl Ag Cl Ag
Ag Cl Ag Cl Ag Cl Ag Cl Ag Cl
Cl Ag Cl Ag Cl Ag Cl Ag Cl Ag
```

The $Ag^+$ and $Cl^-$ pattern in a {110} atomic plane is schematically shown below:

```
  Ag  Ag  Ag  Ag  Ag  Ag  Ag  Ag  Ag  Ag
Cl  Cl  Cl  Cl  Cl  Cl  Cl  Cl  Cl  Cl
  Ag  Ag  Ag  Ag  Ag  Ag  Ag  Ag  Ag  Ag
Cl  Cl  Cl  Cl  Cl  Cl  Cl  Cl  Cl  Cl
  Ag  Ag  Ag  Ag  Ag  Ag  Ag  Ag  Ag  Ag
Cl  Cl  Cl  Cl  Cl  Cl  Cl  Cl  Cl  Cl
  Ag  Ag  Ag  Ag  Ag  Ag  Ag  Ag  Ag  Ag
Cl  Cl  Cl  Cl  Cl  Cl  Cl  Cl  Cl  Cl
```

Within the grain {111} atomic planes consist of all $Cl^{31}$ or all $Ag^+$ in an alternating sequence. Since photographic emulsions contain a stoichiometric excess of halide ions, the surface is believed to be formed of a complete layer of $Ag^+$ onto which is super-imposed a complete or incomplete layer of $Cl^-$. The outermost $Ag^+$ {111} crystal plane exhibits the following configuration:

```
  Ag  Ag  Ag  Ag  Ag  Ag  Ag  Ag  Ag  Ag
Ag  Ag  Ag  Ag  Ag  Ag  Ag  Ag  Ag  Ag
  Ag  Ag  Ag  Ag  Ag  Ag  Ag  Ag  Ag  Ag
Ag  Ag  Ag  Ag  Ag  Ag  Ag  Ag  Ag  Ag
  Ag  Ag  Ag  Ag  Ag  Ag  Ag  Ag  Ag  Ag
Ag  Ag  Ag  Ag  Ag  Ag  Ag  Ag  Ag  Ag
  Ag  Ag  Ag  Ag  Ag  Ag  Ag  Ag  Ag  Ag
Ag  Ag  Ag  Ag  Ag  Ag  Ag  Ag  Ag  Ag
```

When the outermost Cl {111} atomic plane begins to form on the outermost Ag {111} atomic plane, each $Cl^-$ is located equidistant from three $Ag^+$ ions in the underlying {111} crystal plane. When the $Cl^-$ {111} atomic plane is entirely formed, the $Cl^-$ ions are distributed in the same pattern shown above for the $Ag^+$ ions.

From the foregoing it is apparent that each different atomic plane lying at the surface of the tabular grains of the invention presents a markedly different pattern of cations and anions. Compounds that adsorb to or react with the grain surface to provide photographically useful properties select an atomic plane for interaction based on ionic and steric compatibility.

Although ideal grain structures are illustrated above in terms of non-{100} grain faces lying in {110} or {111} atomic planes, it is appreciated that the non-{100} grain faces can alternatively lie in other atomic planes. Maskasky U.S. Pat. No. 4,643,966, here incorporated by reference, discloses silver halide grain structures bounded by {100}, {110}, {111}, {hhl}, {hk0}, {hll} and {hkl} atomic planes, where h, k and l are independently in each occurrence unlike integers greater than zero, where h is greater than l and k, when present, is less than h and greater than 1. Although there is no theoretical limit on the maximum value of the integer h, it is in practice usually 5 or less. After a {100} tabular grain emulsion has been precipitated as a host, precipitation techniques selected from among those taught by Maskasky can be employed for completing grain growth, resulting in the emergence of one or more non-{100} crystal faces on the grains.

The emulsions of the invention can be prepared by modifying the preparation of conventional thin, high aspect ratio high chloride {100} tabular grain emulsions. That is, conventional {100} tabular grains of the type shown in FIG. 3 are first precipitated. Techniques for precipitating an initial thin, high aspect ratio, high chloride {100} tabular grain emulsions are illustrated by Maskasky U.S. Pat. Nos. 5,292,930 and 5,292,632; House et al U.S. Pat. No. 5,320,938; Szajewski et al U.S. Pat. Nos. 5,310,635 and 5,356,764; and Brust et al U.S. Pat. No. 5,314,798; cited above and here incorporated by reference. From 50 to 98 percent, preferably 85 to 95 percent, of the total silver forming the emulsion of the invention is precipitated under these conventional conditions of precipitation. Thereafter, the conditions of precipitation are modified to provide the non-{100} crystal faces while completing grain growth.

In one preferred form of the invention the non-{100} crystal faces are formed while increasing the iodide concentration during precipitation to a level of at least 5 (preferably at least 7) mole percent, based on the silver being concurrently introduced. The iodide can be conveniently added as a silver iodide Lippmann emulsion or as a soluble salt (e.g., KI). The iodide ion concentration level can be increased up to the saturation level of iodide ion in silver chloride. Increasing iodide concentrations above their saturation level in silver chloride runs the risk of precipitating a separate silver iodide phase. Maskasky U.S. Pat. No. 5,288,603, here incorporated by reference, discusses iodide saturation levels in silver chloride and silver bromochloride. The presence of iodide during precipitation in combination with other precipitation parameters results in tabular grain emulsions satisfying the requirements of the invention. Specific illustrations of how iodide incorporation in combination with other precipitation parameters can be utilized to provide tabular grain emulsions satisfying the requirements of the invention are provided in the Examples below. When iodide is relied upon to provide non-{100} crystal faces, the tabular grains can contain as little as 0.1 mole percent iodide, based on total silver, but it is preferred that the grains contain at least about 0.5 mole percent iodide. Tabular grains containing up to 10 mole percent iodide can be prepared using iodide to provide non-{100} edge faces. This preparation approach can be practiced in the presence or absence of bromide. The sum of iodide and bromide can range up to 10 mole percent, based on total silver.

A distinct advantage of employing iodide to provide non-{100} crystal faces is that the inclusion of iodide in the grain structure facilitates latent image formation and can result in realizing increased levels of photographic sensitivity. Further, since the iodide ions are incorporated in the crystal structure, they do not compete with other photographic addenda for adsorption sites on the surfaces the tabular grains.

An alternative to employing iodide for the formation of non-{100} grain faces of the invention is the use of thiocyanate. By using thiocyanate to form the non-{100} grain faces it is possible to precipitate emulsions according to the invention that contain no significant levels of iodide. The thiocyanate can be introduced into the reaction vessel in the form of an alkali, alkaline earth or ammonium salt. Typical thiocyanate concentrations range from 0.2 to 10 (preferably 0.5 to 5) mole percent, based on silver concurrently introduced. Since silver thiocyanate is less soluble than silver chloride, thiocyanate is believed to be incorporated into the grains. As shown in FIG. 5 grains prepared in the presence of thiocyanate during the later stages of precipitation generally exhibit at least one crystal face that is readily recognized not to satisfy the permissible orientations of a {100} atomic plane and hence to be a non-{100} crystal face. The specific techniques for forming the tabular grain emulsions of the invention employing thiocyanate are demonstrated in the Examples below. It is recognized that, instead of selecting thiocyanate or iodide to produce non-{100} grain edges, it is possible to employ both in combination.

In still another alternative form of the invention selected organic compounds can be employed for producing {100} tabular grains with non-{100} crystal faces. In the Examples below 4,5,6-triaminopyrimidine and 2,4,6-triiodophenol, known grain growth modifiers for producing {111} grain faces, and 1-(3-acetamidophenyl)-5-mercaptotetrazole, a known grain growth modifier for the formation of {110} grain faces, are demonstrated to be successful in producing non-{111} edge faces on high chloride {100} tabular grains.

It is noted that 4,5,6-triaminopyrimidine is an example of a formula defined family of {111} growth modifiers disclosed in Maskasky U.S. Pat. No. 5,185,239, the disclosure of which is here incorporated by reference. Specifically disclosed compounds include, in addition to 4,5,6-triaminopyrimidine, 5,6-diamino-4-(N-methylaminopyrimidine, 4,5,6-tri(N-methylamino)pyrimidine, 4,6-diamino-5-(N,N-dimethylamino)pyrimidine and 4,6-diamino-5-(N-hexylamino)pyrimidine. Similar utility is contemplated for various forms of 7-azaindole grain growth modifiers disclosed in Maskasky U.S. Pat. No. 5,178,997, the disclosure of which is here incorporated by reference. In addition to 7-azaindole, specifically disclosed compounds include 4,7-diazaindole, 5,7-diazaindole, 6,7-diazaindole, purine, 4-aza-benzimidazole, 4,7-diazabenzimidazole, 4-azabenzotriazole, 4,7-diazazbenzotriazole and 1,2,5,7-tetraazaindene.

Similarly, 2,4,6-triiodophenol is an example of a family of polyiodophenol {111} grain growth modifiers disclosed in Maskasky U.S. Pat. No. 5,411,852, here incorporated by reference. In addition to 2,4,6-triiodophenol, specifically disclosed compounds include 2,6-diiodophenol, 2,6-diiodo-4-nitrophenol, 2,6-diiodo-4-methylphenol, 4-allyl-2,6-diiodophenol, 4-cyclohexyl-2,6-diiodophenol, 2,6-diiodo-4-phenylphenol, 4,6-diiodo-2-acetophenone, 4,6-diiodothymol, 4,6-diiodocarvacrol, 3,5-diiodo-L-tyrosine, 3',3",5',5"-tetraiodophenolphthalein, erythrosin and rose bengal. Structurally similar to the polyiodophenol grain growth modifiers are the iodoquinoline {111} grain growth modifiers disclosed in Maskasky U.S. Pat. No. 5,399,478, here incorporated by reference. Specific examples of iodoquinoline grain growth modifiers are 5-chloro-8-hydroxy-7-iodoquinoline, 8-hydroxy-7-iodo-2-methylquinoline, 4-ethyl-8-hydroxy-7-iodoquinoline, 5-bromo-8-hydroxyiodoquinoline, 5,7-diiodo-8-hydroxyquinone, 8-hydroxy-7-iodo-5-quinolinesulfonic acid, 8-hydroxy-7-iodo-5-quinolinecarboxylic acid, 8-hydroxy-7-iodo-5-iodomethylquinoline, 8-hydroxy-7-iodo-5-trichloromethylquinoline, α-(8-hydroxy-7-iodoquinoline)acetic acid, 7-cyano-8-hydroxy-5-iodoquinoline and 8-hydroxy-7-iodo-5-isocyanatoquinoline. Similar utility is contemplated for similar {111} grain growth modifiers, such as the various forms of 5-iodobenzoxazolium compounds disclosed in Maskasky U.S. Pat. No. 5,298,387, the disclosure of which is here incorporated by reference, and the various forms of benzimidazolium compounds disclosed in Maskasky U.S. Pat. No. 5,298,388, the disclosure of which is here incorporated by reference.

The utility of 1-(3-acetamidophenyl)-5-mercaptotetrazole (APMT) as a grain growth modifier in the practice of the invention is highly advantageous, since AMPT is a widely used and preferred antifoggant and stabilizer for high chloride photographic emulsions. Thus, the grain growth modifier is capable of serving a second photographic function after the grains have been formed.

AMPT is an example of thionamide compounds known to be useful {110} grain growth modifiers. The common feature of these compounds is a thioamide, —NH— C(S)—, group. Thioamide compounds and their utility as grain growth modifiers are disclosed in Maskasky, "The Seven Different Kinds of Crystal Forms of Photographic Silver Halides," *Journal of Imaging Science*, No. 6, Nov./Dec. 1986, pp. 247–254.

In the preparation of high chloride {111} tabular grain emulsions the use of adsorbed grain growth modifiers to create and preserve the {111} grain faces is disadvantageous, since at least both of the major faces of each {111} tabular grain has a grain growth modifier adsorbed to it. The effective grain growth modifiers identified in this patent application are adsorbed to the faces of the {100} tabular grains that lie in non-{100} atomic planes. That is, non-{100} edge faces emerge because these are the crystal faces for which the effective grain growth modifiers show an adsorption preference. Thus, the grain growth modifiers show a relatively lower affinity for the {100} major faces of the tabular grains, leaving the {100} major faces free to accept other photographic addenda. Hence, high chloride emulsions containing {100} tabular grain emulsions prepared with non-{100} grain edges by employing an adsorbed grain growth modifier exhibit a significant advantage over {111} tabular grain emulsion even when the two emulsions are prepared using identical grain growth modifiers.

The thionamide compound 2-mercaptopyridine and a related compound 5-carboxy-4-hydroxy-6-methyl-2-methylthio-1,3,3*a*, 7-tetraazaindene are demonstrated in the Examples below to have failed to produce tabular grains with grain surfaces lying in different atomic planes. A similar failure is reported in the Examples below for adenine, the original and most widely cited grain growth modifier for precipitating high chloride {111} tabular grains, illustrated by Maskasky U.S. Pat. Nos. 4,400,463 and 4,713,323, Jones et al U.S. Pat. No. 5,176,991, Maskasky U.S. Pat. No. 5,183,239 and Verbeek EPO 0 481 133. Unfortunately, instead of producing non-{100} crystal faces selectively at the edges of the grains, these known grain growth modifiers have caused silver chloride to be deposited over the entire exterior face of the grains, producing grain surface ruffling of the type disclosed by Maskasky U.S. Pat. No. 4,643,966 in addition to sloping edge protrusions. Thus, the objective of obtaining tabular grains with faces having differing crystal plane orientations has not been realized.

It is believed that the success reported in the Examples in achieving non-{100} edge facets while preserving {100} major grain faces has resulted from achieving a balance in which silver and chloride precipitation is occurring nearer to equilibrium. That is in the reaction $$Ag^+ + Cl^- \longleftrightarrow AgCl$$

the driving force is to the right, but is sufficiently limited that the higher reactive energy of the grain substrate at the edge regions as compared to the major faces allows the edge regions to act as preferred reception sites for deposition.

Apart from emulsion grain features specifically discussed, the emulsions of the invention and the photographic elements in which they can be employed can include the features of {100} tabular grain emulsions disclosed by Maskasky U.S. Pat. Nos. 5,292,930 and 5,292,632; House et al U.S. Pat. No. 5,320,938; Szajewski et al U.S. Pats. 5,310,635 and 5,356,764; and Brust et al U.S. Pat. No. 5,314,798; cited above and here incorporated by reference. The features of photographic elements in which the emulsions of the invention can be employed and the use of such photographic elements are further described in *Research Disclosure*, Vol. 365, Sept. 1994, Item 36544. *Research Disclosure* is published by Kenneth Mason Publications, Ltd., Dudley House, 12 North St., Emsworth, Hampshire P010 7DQ, England.

EXAMPLES

The invention can be appreciated by reference to the following specific Examples. The acronym DW is employed to indicate distilled water. Speed is reported in relative log units (i.e., 30 units = 0.3 log E, where E is exposure in lux-seconds).

Example 1

This example demonstrates the preparation of high chloride {100} tabular grain emulsions with edge modifications to provide non-{100} grain faces being provided by an adsorbed organic grain growth modifier.

Host Emulsion H-A

A high chloride {100} tabular grain emulsion was made using the procedures given in House et al U.S. Pat. No. 5,320,938. The tabular grains had a mean equivalent circular diameter of 2.5 μm and a mean thickness of 0.16 μm. No visibly identifiable non-{100} grain faces were present.

Host Emulsion H-B

A high chloride {100} tabular grain emulsion was prepared similar as Host Emulsion H-A. The tabular grains had a mean equivalent circular diameter of 1.5 μm and a mean thickness of 0.13 μm. No visibly identifiable non-{100} grain faces were present.

Emulsion Q

High-Chloride {100} Tabular Grains with {111} Corner Faces, 13Mole % Overgrowth Using 4,5,6-Triaminopyrimidine as Grain Growth Modifier To a stirred reaction vessel containing 0.04 mole of Host Emulsion H-B in 400 mL of a solution at pH 6.0 and at 40° C. that was 2% in bone gelatin, 2.0 mM in 4,5,6-triaminopyrimidine, and 0,040M in NaCl were added 3.0 mL of 2M $AgNO_3$ solution at 1.0 mL/min and 2.5M NaCl solution at a rate needed to maintain a constant pCl of 1.50.

The resulting emulsion was examined by scanning electron microscopy. Greater than 60 percent of total grain projected area was provided by high chloride {100} tabular grains having two sloping faces adjacent each corner. No protrusions above the {100} major faces of the tabular grains were observed. Examination of grain corners at appropriate angles revealed the angle between the two sloping corner faces to be approximately 109° confirming that they are {111} faces. (With this identification, the orientation of the grain's crystal lattice relative to its shape was established and, from this, the orientation of the edge faces perpendicular to the {100} major faces, comparable to faces 306–312 in grain 300 were confirmed to be {100} rather than {110} faces. Thus, the grain was essentially similar to ideal grain structure 300.)

Emulsion R

High-Chloride {100} Tabular Grains with {111} Corner Faces, 23Mole % Overgrowth Using 2,4,6-Triiodophenol as Grain Growth Modifier To a stirred reaction vessel containing 0.04 mole of Host Emulsion H-B in 400 mL of a solution at pH 6.0 and at 60° C. that was 2% in bone gelatin, 0.2 mM in 2,4,6-triiodophenol, 0,040M in NaCl, and 0.20M in sodium acetate were added 3.0 mL of 4M $AgNO_3$ solution at 1.0 mL/min and 4.5M NaCl solution at a rate needed to maintain a constant pCl of 1.42.

The resulting emulsion was examined by scanning electron microscopy. It consisted of high chloride {100} tabular grains having two sloping faces adjacent at each of their corners and no protrusions above the {100} major faces of the tabular grains. Examination of grain corners at appropriate angles revealed the angle between the two corner faces to be approximately 109° confirming that they are {111} faces.

Emulsion S

High-Chloride {100} Tabular Grains with {110} Corner and Edge Faces, 23Mole % Overgrowth Using 1-(3-Acetamidophenyl)-5-mercaptotetrazole as Grain Growth Modifier This emulsion was prepared similarly to that of Emulsion R, except the reaction vessel was made 0.30 mM in 1-(3-acetamidophenyl)-5-mercaptotetrazole and no triiodophenol was added.

The resulting {100} tabular grains had {110} faces along their edges and corners; twelve {110} faces per grain. Thus, the tabular grains were similar to ideal grains 200.

Emulsion T (failure)

High-Chloride Non-{100} Tabular Grains with {110} Corner and Edge Faces, 23Mole % Overgrowth This emulsion was prepared similarly to that of Emulsion R, 2 except that the reaction vessel was made 0.20 mM in 5-carboxy-4-hydroxy-6-methyl-2-methylthio-1,3,3*a*, 7-tetraazaindene and no triiodophenol was added.

Rectangular tabular grains were observed. The edges and corners of the rectangular tabular grains consisted of twelve {110} faces per grain. However, no {100} major faces were in evidence. The major faces of the grains were clearly ruffled, indicative of a grain surface formed by non-{100} pyramidal deposits of the type described by Maskasky U.S. Pat. No. 4,643,966. This demonstrated the ineffectiveness of the tetraazaindene grain growth modifier to produce emulsions satisfying the requirements of the invention.

Emulsion U (failure)

High-Chloride Non-{100} Tabular Grains with {110} Corner and Edge Faces, 23Mole % Overgrowth This example was prepared similarly to that of Emulsion R, except that the reaction vessel was made 0.30 mM in 2-mercaptopyridine and no triiodophenol was added.

The resulting rectangular tabular grains did not contain major {100} faces. The grains exhibited surface features similar to those described above fore Emulsion T.

Emulsion V (failure)

High-Chloride Non-{100} Tabular Grains with {110} Corner and Edge Faces, 23Mole % Overgrowth To a stirred reaction vessel containing 0.04 mole of Host Emulsion H-A in 400 mL of a solution at pH 6.2 and at 75° C. that was 2% in bone gelatin, 3.9 mM in adenine, 0.037M in NaCl, and 0.20M in sodium acetate were added 15.0 mL of 4M $AgNO_3$ solution at 1.0 mL/min and 4.5M NaCl solution at a rate needed to maintain a constant pCl of 1.43.

The resulting emulsion was examined by scanning electron microscopy. The resulting grains had ruffled surfaces and {111} corner faces. No {100} major faces were observed.

The invention has been described in detail with particular reference to preferred embodiments thereof, but it will be understood that variations and modifications can be effected within the spirit and scope of the invention.

What is claimed is:

1. A radiation sensitive emulsion containing a silver halide grain population comprised of at least 90 mole percent chloride, based on silver, wherein at least 50 percent of the total grain population projected area is accounted for by tabular grains (1) bounded by parallel major faces lying in {100} atomic planes and having adjacent edge ratios of less than 10, (2) having a thickness of less than 0.2 μm, and (3) having an average aspect ratio of greater than 8, wherein each of the tabular grains accounting for at least 50 percent of the total grain projected area (4) is comprised of eight equivalent crystal faces lying in like atomic planes that differ from the {100} atomic planes and (5) exhibits a lower grain volume than a tabular grain of the same length, width and thickness bounded entirely by crystal faces lying in {100} atomic planes.

2. A radiation sensitive emulsion according to claim 1 wherein each of the equivalent crystal faces lies in a {111} atomic plane and extends from one of the major faces to grain corner.

3. A radiation sensitive emulsion according to claim 1 wherein each of the equivalent crystal faces lies in a {110} atomic plane and extends from an edge of one of the major faces to a peripheral grain edge that is laterally displaced from the edge of the one major face.

4. A radiation sensitive emulsion according to claim 1 wherein a grain growth modifier is preferentially adsorbed to each of the equivalent crystal faces.

5. A radiation sensitive emulsion according to claim 4 wherein the grain growth modifier is selected from among 4,5,6-triaminopyrimidines, 7-azaindoles, polyiodophenols and iodoquinolines.

6. A radiation sensitive emulsion according to claim 1 wherein a 1-(3-acetamidophenyl)-5-mercaptotetrazole grain growth modifier is preferentially adsorbed to each of the equivalent crystal faces.

* * * * *